United States Patent [19]

Acree

[11] Patent Number: 4,568,298

[45] Date of Patent: Feb. 4, 1986

[54] DOLL WITH LIQUID-FILLED TORSO AND REMOVABLE LIQUID FILL PORT SEAL

[76] Inventor: Rita G. Acree, 153 Holland Dr., Virginia Beach, Va. 23462

[21] Appl. No.: 689,594

[22] Filed: Jan. 7, 1985

Related U.S. Application Data

[63] Continuation-in-part of Ser. No. 587,942, Mar. 9, 1984, abandoned.

[51] Int. Cl.[4] ..... A63H 3/00

[52] U.S. Cl. ..... 446/74; 446/371; 446/268

[58] Field of Search ..... 446/74, 73, 72, 391, 446/376, 369, 371, 321, 267, 268

[56] References Cited

U.S. PATENT DOCUMENTS 1,346,176 7/1920 Chambers ..... 446/74 X
1,758,024 5/1930 Blomquist ..... 446/74
1,828,765 10/1931 Crist ..... 446/371
3,866,350 2/1975 Goldfarb et al. ..... 446/391 X

FOREIGN PATENT DOCUMENTS 997078 12/1951 France ..... 446/74

*Primary Examiner*—Mickey Yu

[57] ABSTRACT

A doll figure representing a baby or other human figure having a torso enclosing rubber-like liquid reservoir substantially filled with water, has removable reservoir liquid fill port, permitting addition and removal of liquid from reservoir after doll's manufacture.

Threaded nipple extends from the bottom of doll's head and screws into threaded collar located at top of doll's torso. Unscrewing of head from torso provides access to fill port plug. Snap-type fasteners joining bottom of doll's head to clothing secures head from accidental or premature removal from torso.

5 Claims, 4 Drawing Figures

DOLL WITH LIQUID-FILLED TORSO AND REMOVABLE LIQUID FILL PORT SEAL

CROSS-REFERENCE TO RELATED PATENTS

This application is a continuation-in-part of my co-pending U.S. patent application, Ser. No. 06/587,942, filed Mar. 9, 1984 now abandoned.

FIELD OF INVENTION

The present invention relates to creature representations such as flexible figure toys, robots, models, and dolls. In particular, the present invention relates to baby dolls having liquid-filled, compressible torsos with threaded means for securing the "heads" of the dolls to the torsos.

BACKGROUND

Various forms of dolls are known into which a liquid may be introduced. Some such dolls have reservoirs for storing small quantities of such liquids. Generally, liquids stored by such dolls are used for ancilliary purposes such as hydraulically activating appendages; or duplicating bodily functions such as blood circulation, drinking or wetting; or for internal heating. Liquids in such dolls are often of such small volume relative to the volume of the doll taken as a whole, that they have little influence on the overall weight, density or "feel" of the dolls.

A type of doll having a liquid-filled resevoir that substantially fills the doll's torso is described in my co-pending patent application, Ser. No. 06/587,942, filed Mar. 9, 1984.

A problem of dolls having liquid storage resevoirs is that the reservoirs often rupture, particularly at their liquid fill ports, as a result of abusive treatment by young children who typically play with such dolls.

Another problem of dolls that have liquid storage reservoirs is that the liquid fill ports of such dolls are often permanently closed by the dolls' manufacturers so that liquid cannot be added to or removed from the reservoir after manufacture.

OBJECTS

Accordingly, it is an object of the present invention to provide a doll figure having a pliable, rubber-like liquid storage reservoir substantially filling its torso whereby said liquid may be easily added to or removed from its resevoir.

It is a further object of the present invention to provide a doll of the character described in which the port through which said liquid is introduced into said reservoir may be securely closed within the doll when the doll is assembled.

It is another object of the present invention to provide a doll of the character described in which the "head" of the doll can be removably attached to said rubber-like reservoir.

It is another object of the present invention to provide a doll of the character described in which the removably attached "head" of the doll can be screwed onto the torso of the doll and to provide a means for preventing the head of the doll from prematurely unscrewing from the torso.

These and further objects and advantages of the present invention will become better understood by those skilled in the art by reference to the drawings and ensuing description thereof.

DRAWINGS

DESCRIPTION

Figure 1:
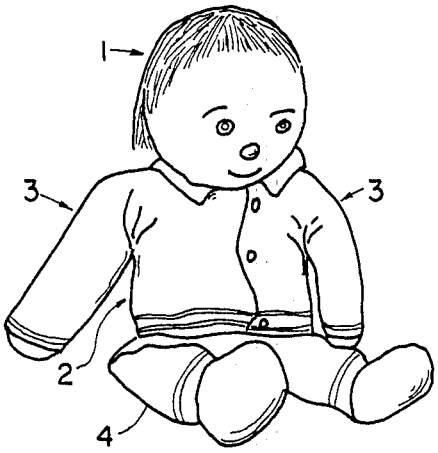
FIG. 1 is a perspecitve view showing the front of a doll incorporating the present invention.
Figure 2:
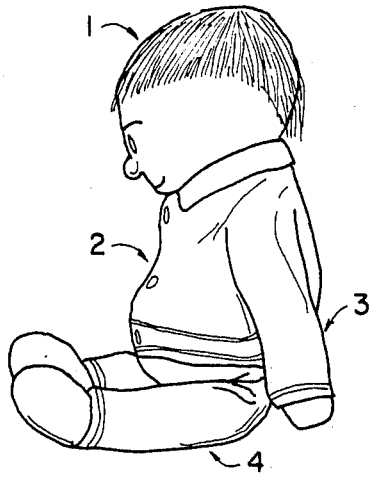
FIG. 2 is a side view of a doll incorporating the present invention.

Referring to FIGS. 1 and 2, the present invention is a doll figure generally comprising a head (1), a torso (2), two arms (3) and two legs (4).

Figure 3:
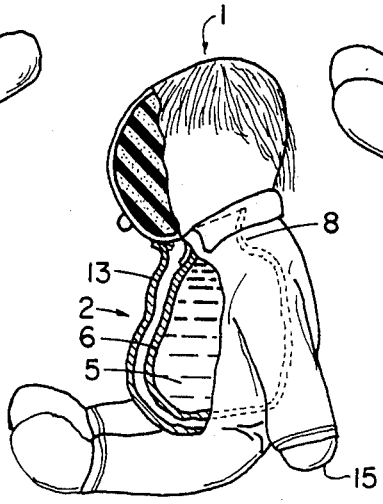
FIG. 3 is a side view of a doll incorporating the present invention in partial section showing construction of liquid reservoir and its location relative to the doll's head and torso.
Figure 4:
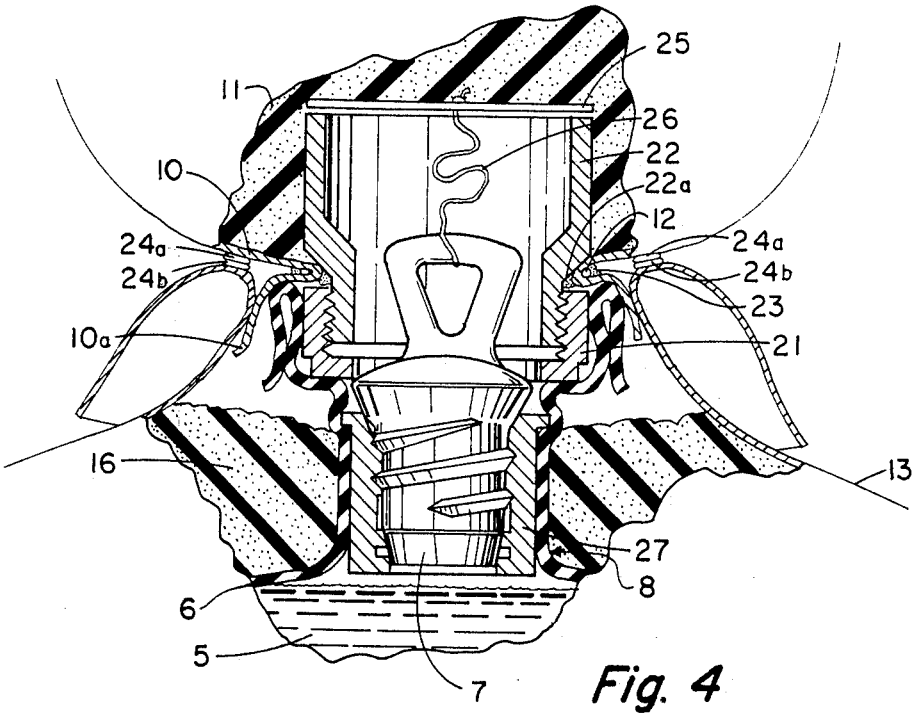
FIG. 4 is an enlarged cross-sectional view of the present invention.

Referring to FIGS. 3 and 4, torso (2) is comprised of a reservoir (6) substantially filled with liquid (5). Reservoir (6) has a narrow neck (8) through which liquid may be introduced into the reservoir (6). Threaded plug (7) is provided within narrow neck (8) of reservoir (6).

Adapter (21) is secured inside of neck (8) of reservoir (6) above plug (7) and has female threads suitable for engagement with male threads of threaded fitting (22).

Head (1) of doll is comprised of a continuous outer fabric (10) which is open at its bottom, and a low density pliable foam filler (11). Head (1) is secured to an externally threaded fitting (22) by string (12) which ties open end of fabric (10) to threaded fitting (22). In the preferred embodiment of the invention, hot glue (23) or other adhesive is used to help secure fabric (10) to threaded fitting (22) and to protect string (12) from abrasion.

Torso (2) assembly is covered by clothing (13) having arms (3) and legs (4). Loose end 10*a* of head fabric (10) is tucked inside of doll's clothing (13). Head fabric (10) and clothing (13) are provided with pairs of snaps (24*a*) and (24*b*), respectfuly, so that head (1) may be "snapped" to clothes (13). Clothing (13) at arms (3) and legs (4) and around resevoir (6) are filled with low density pliable foam (16). Synthetic hands (15) may be sewn to arms (3).

Plate (25) is located inside of head (1) and is connected by string (26) to plug (7).

PREFERRED EMBODIMENT

In the preferred embodiment of the invention, reservoir (6) is made of a durable rubber-like material. Head (1) of doll can be removed from torso (2) by first unsnapping snaps (24*a*) and (24*b*) and then rotating the head (1) so as to unscrew threaded fitting (22) from an internally threaded first collar (21). Once the head (1) of the doll has been removed from the torso, threaded plug (7) becomes accessible and may then be removed from reservoir neck (8) opening. Liquid (5) is introduced into resevoir (6) through opening in neck (8) which is exposed by temporary removal of plug (7). In the preferred embodiment of the invention liquid (5) is water. Since water is incompressible (within practical limits), it is desirable to fill resevoir (6) to just below full capacity so that reservoir remains slightly compressible when closed, that is, when plug (7) is secured in place.

By selectively filling resevoir (6) with water (5) to the desired percentage of full capacity, the compressibility, or "feel", of the torso may be selected.

Plug (7) is provided with tapered external threads which engage with internal threads of reservoir neck (8), and by which mean a liquid-tight seal is effected to contain water (5) inside of reservoir (6). In the preferred embodiment of the invention, the weight of liquid (5) within reservoir (6) accounts for over 90% of the weight of the entire torso (2) of the doll. As such, the specific gravity of the torso of the doll approaches one, and thereby approximates the density of live humans.

It will be appreciated from the above description that the weight, density and compressibility of the torso (2) of the doll may be selected to approach both the compressibility (or "feel") and the density of live humans.

In the preferred embodiment of the invention, a second internally threaded collar insert (27) is located inside of, and affixed to, reservoir neck (8) and is suitable for engagement with threaded plug (7). Threaded fitting (22) is located at bottom of head (1). In the preferred embodiment of the invention, threaded fitting (22) is a pipe nipple having a shoulder (22*a*) against which head fabric (10) is tied to the nipple. Sufficient length of the threaded fitting (22) extends beyond the bottom of head (1) to permit its threaded engagement with first threaded collar (21). First threaded collar (21) is bonded to reservoir (6) with a suitable bonding agent such as hot glue, epoxy or a urethane adhesive (not shown). Loose end (10*a*) of head fabric may be tucked inside of clothes (13). Pairs of snaps (24*a*, 24*b*) are provided in head fabric (10) and clothes (13) so that clothes and head may be temporarily attached to each other. "Velcro", zippers, buttons or similar means can be used in place of snaps (24*a*, 24*b*); although snaps have been found to be preferrable.

With snaps (24*a*, 24*b*) open, (i.e. unsnapped), head (1) can be rotated relative to torso (2) so that threaded fitting (22) becomes disengaged from first threaded collar (21), permitting head (1) to be removed from torso (2). With head removed from the torso, threaded plug (7) is exposed. By rotating threaded plug (7), it can be disengaged and removed from the second threaded collar (27), thereby providing an opening through which liquid (5) may be introduced into the resevoir (6).

Once reservoir (6) is filled with liquid (5), threaded plug (7) can be re-inserted into second threaded collar (27); threaded fitting (22) with attached head can be screwed back into the first threaded collar (21); loose end (10*a*) of head fabric can be tucked into clothing; and snaps (24*a*, 24*b*) can be snapped together.

It will be appreciated from the foregoing that the invention thus described provides a means for removing or adding liquid (5) to resevoir (6) by a series of specific sequential steps at any time after the doll's manufacture. Additionally, it will be appreciated by those skilled in the art that once the doll is fully assembled, plug (7) is safely located within the interior of the doll where it is un-exposed and protected from physical abuse and accidental openning.

In the preferred embodiment of the present invention, threaded fitting (22) is a hollow cylinder openning into the interior of the doll's head (1). Plate (25) is disposed between end of threaded fitting (22) and foam filler (11), and is attached by string (26) or other similar common means to the top of threaded plug (7). Plate (25) provides a barrier to foam filler (11) to prevent its (foam filler's) falling into interior of nipple. In addition to holding plate (25) in place, string (26) serves as a means for keeping head of doll permanently attached to plug (7) so that plug does not become lost.

While the above description contains specificities, these should not be construed a limitations on the scope of the invention, but rather as an exemplification of one preferred embodiment thereof. Many variations are possible, for example: The second threaded collar insert (27) and reservoir neck (8) may be a common part; and threaded fitting (22) and plate (25) may be a common part.

Accordingly, the scope of the invention should be determined not by the emodiment illustrated, but by the appended claims and their legal equivalents.

I claim:

1. In a doll having a head and a body comprising a flexible liquid reservoir located within said body; said reservoir having an orifice through which said liquid may be introduced into said reservoir; a plug by which means said orifice may be closed; a fabric covering said head; and means for attaching said head to said flexible liquid reservoir, the improvement in which:

said means for attaching said head to said flexible liquid reservoir comprises an internally threaded 1st collar extending from said orifice in said reservoir;

means for bonding said 1st collar to said reservoir;

an externally threaded fitting extending from the bottom of said head suitable for engagement with said 1st threaded collar;

means for bonding said fitting to said head; and mechanical means for temporarily fastening said head fabric to said body.

2. The device described in claim 1 in which said orifice comprises a second internally threaded collar disposed within said reservoir a finite distance below the top of said reservoir, and said plug is externally threaded and is suitable for engagement with said second collar.

3. The device as described in claim 2 in which said means for securing said fitting to said head comprises a flexible cord by which means said fabric is tied to said fitting and further comprises an adhesive substance by which means said fabric is bonded to said fitting and by which means said flexible cord is bonded to said fabric.

4. The device as described in claim 3 in which said body is at least partially enclosed in clothing and in which said mechanical means for temporarily securing said head fabric to said body comprises one or more pairs of mechanical "snaps" attached to said head fabric and said clothing, respectfully.

5. The device according to claim 4 in which said head comprises a compressible solid; said fitting comprises a hollow cylinder; further comprising a plate disposed between the top of said fitting and said compressible solid head; and said said said plate is connected to said plug by a second flexible cord passing through said hollow cylinder and secured to said plate and said plug, respectfully.

* * * * *